US010153098B2

(12) United States Patent
Hayashi et al.

(10) Patent No.: US 10,153,098 B2
(45) Date of Patent: Dec. 11, 2018

(54) METHOD FOR PRODUCING ELECTRODE MATERIAL AND ELECTRODE MATERIAL

(71) Applicant: MEIDENSHA CORPORATION, Tokyo (JP)

(72) Inventors: Shota Hayashi, Tokyo (JP); Keita Ishikawa, Tokyo (JP); Takaaki Furuhata, Shizuoka (JP); Kenta Yamamura, Numazu (JP); Kosuke Hasegawa, Numazu (JP)

(73) Assignee: MEIDENSHA CORPORATION, Tokyo (JP)

( * ) Notice: Subject to any disclaimer, the term of this patent is extended or adjusted under 35 U.S.C. 154(b) by 0 days.

(21) Appl. No.: 15/570,433

(22) PCT Filed: Apr. 26, 2016

(86) PCT No.: PCT/JP2016/063032
§ 371 (c)(1),
(2) Date: Oct. 30, 2017

(87) PCT Pub. No.: WO2016/178388
PCT Pub. Date: Nov. 10, 2016

(65) Prior Publication Data

US 2018/0174771 A1 Jun. 21, 2018

(30) Foreign Application Priority Data

May 1, 2015 (JP) ..... 2015-093765
Aug. 19, 2015 (JP) ..... 2015-161482

(51) Int. Cl.
*H01H 11/04* (2006.01)
*H01H 1/02* (2006.01)
(Continued)

(52) U.S. Cl.
CPC ..... *H01H 1/0206* (2013.01); *B22F 1/00* (2013.01); *B22F 1/0003* (2013.01); *B22F 5/00* (2013.01);
(Continued)

(58) Field of Classification Search
None
See application file for complete search history.

(56) References Cited

U.S. PATENT DOCUMENTS 4,830,821 A * 5/1989 Okutomi ..... C22C 1/0475 419/25
2002/0068004 A1 6/2002 Doh et al.
(Continued)

FOREIGN PATENT DOCUMENTS

EP 2 323 148 A1 5/2011
JP 04-334832 A 11/1992
(Continued)

OTHER PUBLICATIONS

Werner F. Rieder et al., The Influence of Composition and Cr Particle Size of Cu/Cr Contacts on Chopping Current, Contact Resistance, and Breakdown Voltage in Vacuum Interrupters, IEEE Transactions on Components, Hybrids, and Manufacturing Technology, vo., 12, No. 2, Jun. 1989, pp. 273-283.

*Primary Examiner* — Truc Nguyen
(74) *Attorney, Agent, or Firm* — Foley & Lardner LLP

(57) ABSTRACT

It is a method for producing an electrode material containing Cu, Cr and a heat-resistant element. A heat-resistant element powder and a Cr powder are mixed together such that the heat-resistant element is less than the Cr by weight. A resulting mixed powder is baked. A resulting sintered body containing a solid solution of the heat-resistant element and the Cr is pulverized, and a resulting solid solution powder is classified, to have a particle size of 200 μm or less. 10-60 parts by weight of the classified solid solution powder and
(Continued)

90-40 parts by weight of a Cu powder are mixed together, followed by sintering to obtain the electrode material. If a low melting metal powder having a median size of 5-40 μm is mixed with a mixed powder of the solid solution powder and the Cu powder, the deposition resistance property is further improved.

11 Claims, 8 Drawing Sheets

(51) Int. Cl.

| | |
|---|---|
| ***B22F 1/00*** | (2006.01) |
| ***B22F 5/00*** | (2006.01) |
| ***B22F 9/04*** | (2006.01) |
| ***C22C 1/04*** | (2006.01) |
| ***C22C 9/00*** | (2006.01) |
| ***C22C 27/06*** | (2006.01) |
| ***H01H 1/025*** | (2006.01) |
| ***H01H 33/662*** | (2006.01) |
| ***H01H 33/664*** | (2006.01) |

(52) U.S. Cl.
CPC ..... *B22F 9/04* (2013.01); *C22C 1/04* (2013.01); *C22C 1/0425* (2013.01); *C22C 9/00* (2013.01); *C22C 27/06* (2013.01); *H01H 1/025* (2013.01); *H01H 11/048* (2013.01); *H01H 33/662* (2013.01); *H01H 33/664* (2013.01); *B22F 2301/10* (2013.01); *H01H 11/04* (2013.01); *H01H 2201/03* (2013.01)

(56) References Cited

U.S. PATENT DOCUMENTS

| | | | | |
|---|---|---|---|---|
| 2002/0144977 | A1* | 10/2002 | Kikuchi | H01H 1/0203 218/123 |
| 2009/0009852 | A1* | 1/2009 | Honeyman | G02F 1/167 359/296 |
| 2017/0066055 | A1* | 3/2017 | Kitakizaki | C22C 9/00 |

FOREIGN PATENT DOCUMENTS

| | | | |
|---|---|---|---|
| JP | 2002-180150 | A | 6/2002 |
| JP | 2003-77375 | A | 3/2003 |
| JP | 2011-108380 | A | 6/2011 |

* cited by examiner (a) COM. EX. 1

(b) EXAMPLE 1

(C) COM. EX. 3

NO SIEVE (CLASSIFICATION) AFTER MoCr SINTERED BODY PULVELIZATION

<MICROSCOPE IMAGE (×100)>

METHOD FOR PRODUCING ELECTRODE MATERIAL AND ELECTRODE MATERIAL

TECHNICAL FIELD

The present invention relates to a method for producing an electrode material, which is used for an electrode of vacuum interrupters, etc., and to the electrode material.

BACKGROUND ART

The contact material of vacuum interrupters is required to satisfy characteristics, such as (1) the breaking capacity being large, (2) the withstand voltage capability being high, (3) the contact resistance being low, (4) the deposition resistance property being high, (5) the contact consumption being low, (6) the chopped current being low, (7) the workability being excellent, and (8) the mechanical strength being high.

Since some of these characteristics conflict with each other, there is no contact material satisfying all of the above characteristics. Cu—Cr electrode materials have characteristics, such as the breaking capacity being large, the withstand voltage capability being high, and the deposition resistance property being high. Therefore, they are widely used as contact materials of vacuum interrupters. Furthermore, there is a report that, in Cu—Cr electrode materials, one having a finer particle size of Cr particles is superior in breaking current and contact resistance (for example, Non-patent Publication 1).

In recent years, there has been progress in making vacuum interrupters conducting arc extinction of vacuum circuit breakers have smaller sizes and larger capacities. Thus, there has been an increasing demand for Cu—Cr based contact materials having withstand voltage capabilities superior to those of conventional Cu—Cr electrodes, which are essential for making vacuum interrupters have smaller sizes. Furthermore, the use conditions of vacuum interrupter users have become severe, and the expansion of applying vacuum interrupters to capacitor circuits has been progressing. In capacitor circuits, the voltage that is the double or triple of normal voltage is applied between the electrodes. With this, the contact surface tends to be considerably damaged by arc at the time of the current breaking and the current opening and closing, and reignition of arc tends to occur. Therefore, there is an increasing demand for electrode materials having breaking capabilities and withstand voltage capabilities, superior to those of conventional Cu—Cr electrode materials.

For example, in Patent Publication 1, there is described a method for producing an electrode material, in which, as a Cu—Cr based electrode material excellent in electrical characteristics such as current breaking capability and withstand voltage capability, respective powders of Cu used as a base material, Cr for improving electrical characteristics, and a heat-resistant element (Mo, W, Nb, Ta, V, Zr) for making the Cr particles finer are mixed together, and then the mixed powder is put into a mold, followed by pressure forming and making a sintered body. Specifically, a heat-resistant element, such as Mo, W, Nb, Ta, V or Zr, is added to a Cu—Cr based electrode material containing as a raw material a Cr having a particle size of 200-300 μm, and the Cr is made fine through a fine texture technology, an alloying process of the Cr element and the heat-resistant element is accelerated, the precipitation of fine Cr—X (Cr making a solid solution with the heat-resistant element) particles in the inside of the Cu base material texture is increased, and the Cr particles having a diameter of 20-60 μm in a configuration to have the heat-resistant element in its inside are uniformly dispersed in the Cu base material texture. Furthermore, in Patent Publication 1, there is a description that it is important to increase the content of the Cr or the heat-resistant element in the Cu base material in the Cu based electrode material and to conduct a uniform dispersion after making the particle size of Cr, etc. fine, in order to improve electrical characteristics such as current breaking capability and withstand voltage capability in electrode materials for vacuum interrupters.

Furthermore, in Patent Publication 2, without going through the fine texture technology, a powder obtained by pulverizing a single solid solution that is a reaction product of a heat-resistant element is mixed with a Cu powder, followed by pressure forming and then sintering to produce an electrode material containing Cr and the heat-resistant element in the electrode texture.

However, if the pulverized arc-resistant metal (the heat-resistant element and Cr element) powder and Cu powder are mixed together as described in Patent Publication 2, depending on the mixing proportion of the heat-resistant element and Cr powder, the arc-resistant metal may aggregate in the electrode texture to cause lowering of the withstand voltage property and the breaking capability.

Furthermore, as described in Patent Publication 3, even if electrode materials have the same composition, they become different in breaking characteristic and conductivity, depending on also the particle size distribution of the Cr powder (and the heat-resistant element powder) to be mixed with the Cu powder.

PRIOR ART PUBLICATIONS

Patent Publications

Patent Publication 1: JP Patent Application Publication 2002-180150.

Patent Publication 2: JP Patent Application Publication Heisei 4-334832.

Patent Publication 3: JP Patent Application Publication 2003-77375.

Patent Publication 4: JP Patent Application Publication 2011-108380.

Non-Patent Publications

Non-patent Publication 1: Rieder, F. u. a., "The Influence of Composition and Cr Particle Size of Cu/Cr Contacts on Chopping Current, Contact Resistance, and Breakdown Voltage in Vacuum Interrupters", IEEE Transactions on Components, Hybrids, and Manufacturing Technology, Vol. 12, 1989, 273-283.

SUMMARY OF THE INVENTION

It is an object of the present invention to provide a technology contributing to the improvement of withstand voltage capability of characteristics which electrode materials require.

According to one aspect of a method for producing an electrode material of the present invention for achieving the above object, there is provided a method for producing an electrode material by sintering a mixed powder containing 40-90% Cu, 5-48% Cr and 2-30% heat-resistant element by weight, in which a heat-resistant element powder and a Cr powder are mixed together in a ratio such that the heat-resistant element is less than the Cr by weight, a mixed powder of the heat-resistant element powder and the Cr powder are baked, a sintered body that has been obtained by the sintering and contains a solid solution of the heat-resistant element and the Cr is pulverized, a solid solution powder that has been obtained by the pulverizing is classified to have a particle size of 200 μm or less, and a solid solution powder that has been obtained by the classifying and a Cu powder are mixed together, followed by the sintering.

Furthermore, according to another aspect of a method for producing an electrode material of the present invention for achieving the above object, in the method for producing an electrode material, the solid solution powder that has been obtained by the classifying is such that a volume relative particle amount of a particle having a particle size of 90 μm or less is 90% or greater.

Furthermore, according to another aspect of a method for producing an electrode material of the present invention for achieving the above object, in the method for producing an electrode material, a low melting metal powder that is 0.05-0.3% by weight and has a median size of 5-40 μm is mixed with a mixed powder of the solid solution powder obtained by the classifying and the Cu powder, and then a mixed powder obtained by mixing the low melting metal powder is sintered.

Furthermore, according to another aspect of a method for producing an electrode material of the present invention for achieving the above object, in the method for producing an electrode material, the heat-resistant element powder has a median size of 10 μm or less.

Furthermore, according to another aspect of a method for producing an electrode material of the present invention for achieving the above object, in the method for producing an electrode material, the Cr powder has a median size that is greater than that of the heat-resistant element powder and is 80 μm or less.

Furthermore, according to another aspect of a method for producing an electrode material of the present invention for achieving the above object, in the method for producing an electrode material, the Cu powder has a median size of 100 μm or less.

Furthermore, according to another aspect of a method for producing an electrode material of the present invention for achieving the above object, in the method for producing an electrode material, the heat-resistant element is Mo.

Furthermore, according to one aspect of an electrode material of the present invention for achieving the above object, there is provided an electrode material containing 40-90% Cu, 5-48% Cr and 2-30% heat-resistant element by weight, in which a heat-resistant element powder and a Cr powder are mixed together in a ratio such that the heat-resistant element is less than the Cr by weight, a mixed powder of the heat-resistant element powder and the Cr powder are baked, a sintered body that has been obtained by the sintering and contains a solid solution of the heat-resistant element and the Cr is pulverized, a solid solution powder that has been obtained by the pulverizing is classified to have a particle size of 200 μm or less, and a solid solution powder that has been obtained by the classifying and a Cu powder are mixed together, followed by sintering.

According to another aspect of an electrode material of the present invention for achieving the above object, in the electrode material, a low melting metal powder that is 0.05-0.3% by weight and has a median size of 5-40 μm is mixed with a mixed powder of the solid solution powder obtained by the classifying and the Cu powder, and then a mixed powder obtained by mixing the low melting metal powder is sintered.

Furthermore, according to another aspect of an electrode material of the present invention for achieving the above object, in the electrode material, the electrode material has a packing percentage of 90% or greater and a Brinell hardness of 50 or greater.

Furthermore, in a vacuum interrupter of the present invention for achieving the above object, a movable electrode or a fixed electrode is equipped with an electrode contact comprising any of the above electrode materials.

MODE FOR IMPLEMENTING THE INVENTION

Figure 1:
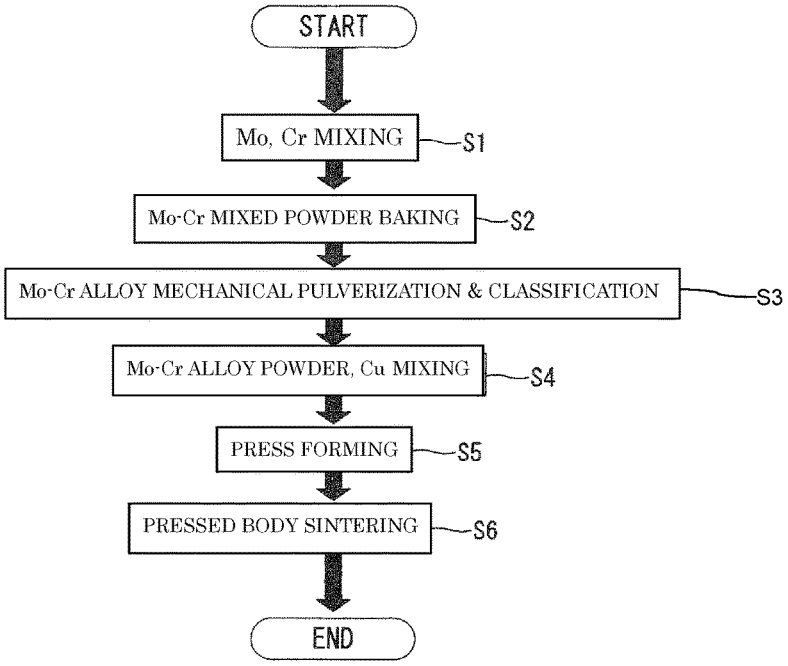
FIG. 1 is a flowchart of an electrode material production method according to the first embodiment of the present invention.

An electrode material production method and an electrode material according to an embodiment of the present invention and a vacuum interrupter having an electrode material according to an embodiment of the present invention are explained in detail with reference to the drawings. In the explanation of the embodiment, unless otherwise stated, the particle size (median size d50), the average particle size, the particle distribution, the volume relative particle amount, etc. refer to values determined by a laser diffraction-type, particle size distribution measurement apparatus (a company CILAS; CILAS 1090L). Furthermore, in case that the upper limit (or lower limit) of the particle size of a powder is defined, it refers to a powder classified by a sieve having an opening of the upper limit value (or lower limit value) of the particle size.

First Embodiment

The invention according to the first embodiment is an invention related to a composition control technique of a Cu—Cr-heat resistant element (Mo, W, V, etc.) electrode material. It is one in which withstand voltage capability is improved by optimizing the pulverization condition of the MoCr reaction product (particle size distribution of the high melting metal) without lowering packing percentage and conductivity, as compared with conventional electrodes (Cu—Cr electrodes). According to the electrode material of the invention according to the first embodiment, it becomes possible to produce a vacuum interrupter with a high breakdown strength and a large capacity.

As the heat-resistant element, an element selected from elements, such as molybdenum (Mo), tungsten (W), tantalum (Ta), niobium (Nb), vanadium (V), zirconium (Zr), beryllium (Be), hafnium (HI), iridium (Ir), platinum (Pt), titanium (Ti), silicon (Si), rhodium (RI) and ruthenium (Ru), can be used singly or in combination. In particular, it is preferable to use Mo, W, Ta, Nb, V or Zr, which is remarkable in the effect of making the Cr particles fine. In the case of using the heat-resistant element as powder, the median size d50 of the heat-resistant element powder is adjusted, for example, to 10 μm or less. With this, it is possible to make Cr-containing particles (containing a solid solution of the heat-resistant element and Cr) fine and uniformly disperse them in the electrode material. By containing 2-30 weight %, more preferably 2-10 weight %, of the heat-resistant element relative to the electrode material, it is possible to improve withstand voltage capability and current breaking capability of the electrode material without lowering mechanical strength and workability. Since the classification is conducted in the electrode material production step in the embodiment of the present invention, it is not possible to precisely define the weight of the heat-resistant element (and Cr) in the electrode material. However, the powder containing the heat-resistant element and Cr to be removed in the classification step is 4% or less of the whole of the powder. Thus, the change of the mixing ratio of the heat-resistant element (and Cr) by the classification is less than ±1% in terms of mixing proportions of Cu, Cr and Mo. Although the mixing ratio of the heat-resistant element and Cr changes by the classification, it is to the extent that the electrode capability is not affected. Therefore, it is possible to regard the weight of the heat-resistant element (and Cr) of the raw material as the composition of the electrode material.

By containing 5-48 weight %, more preferably 5-16 weight %, of chromium (Cr) relative to the electrode material, it is possible to improve withstand voltage capability and current breaking capability of the electrode material without lowering mechanical strength and workability. In the case of using Cr powder, the median size d50 of Cr powder is not particularly limited as long as it is greater than the median size of the heat-resistant element powder. For example, a Cr powder having a median size of 80 μm or less is used.

By containing 40-90 weight %, more preferably 80-90 weight %, of copper (Cu) relative to the electrode material, it is possible to reduce contact resistance of the electrode material without lowering withstand voltage capability and current breaking capability. By adjusting median size d50 of Cu powder, for example, to 100 μm or less, it is possible to uniformly mix a solid solution powder of the heat-resistant element and Cr with Cu powder. In the electrode material to be produced by the sintering method, it is possible to freely set the Cu weight ratio by adjusting the amount of Cu powder to be mixed with a solid solution powder of the heat-resistant element and Cr. Therefore, the total of the heat-resistant element, Cr and Cu to be added to the electrode material never exceeds 100 weight %.

The electrode material production method according to the first embodiment of the present invention is explained in detail with reference to flow of FIG. 1. The explanation of the embodiment is conducted by showing Mo as an example, but it is similar in the case of using another heat-resistant element powder, too.

In the Mo—Cr mixing step S1, the heat-resistant element powder (e.g., Mo powder) is mixed with Cr powder. The Mo powder and the Cr powder are mixed together such that the weight of the Cr powder becomes greater than the weight of the Mo powder. The Mo powder and the Cr powder are mixed together, for example, in a range that Mo/Cr=1/4 to 1/1 (Mo:Cr=1:1 is not included) by weight.

In the baking step S2, a mixed powder of Mo powder and Cr powder is baked. In the baking step S2, a compact of the mixed powder is retained in a vacuum atmosphere at a temperature of 9004200° C. for 1 to 10 hours to obtain MoCr sintered body. In case that the weight of the Cr powder is greater than that of the Mo powder in the mixed powder, there remains Cr that does not form a solid solution with Mo after the baking. Therefore, there is obtained a porous body (MoCr sintered body) containing a MoCr alloy resulting from solid phase diffusion of Cr into Mo and the remaining Cr particles.

In the pulverization and classification step S3, the MoCr sintered body obtained by the sintering step S2 is pulverized by a ball mill, etc. MoCr powder to be obtained by pulverizing the MoCr sintered body is classified, for example, by a sieve having an opening of 90 μm to remove particles having large particle sizes. The pulverization in the pulverization and classification step S3 is conducted, for example, for two hours per 1 kg of the MoCr sintered body. The average particle size of the MoCr powder after the pulverization becomes different, depending on the mixing ratio of Mo powder and Cr powder.

In the Cu mixing step S4, MoCr powder obtained by the pulverization and classification step S3 is mixed with Cu powder.

In the press forming step S5, forming of a mixed powder obtained by the Cu mixing step S4 is conducted. If a compact is produced by a press molding, it is not necessary to conduct machining on the compact after the sintering. Therefore, it can directly be used as an electrode (electrode contact material).

In the primary sintering step S6, a compact obtained by the press forming step S5 is sintered to produce an electrode material. In the primary sintering step S6, sintering of the compact is conducted, for example, in a non-oxidizing atmosphere (hydrogen atmosphere, vacuum atmosphere, etc.) at a temperature lower than Cu melting point (1083° C.).

Figure 2:
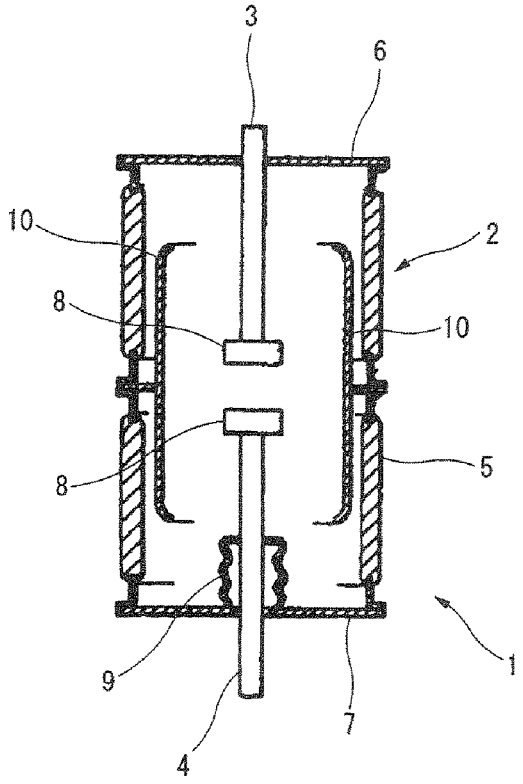
FIG. 2 is a schematic sectional view showing a vacuum interrupter having the electrode material according to the embodiment of the present invention.

By using the electrode material according to the first embodiment of the present invention, it is possible to construct a vacuum interrupter. As shown in FIG. 2, a vacuum interrupter 1 having the electrode material according to the embodiment of the present invention has a vacuum container 2, a fixed electrode 3, a movable electrode 4, and a main shield 10.

The vacuum container 2 is formed by sealing both opening end portions of an insulating sleeve 5 with a fixed-side end plate 6 and a movable-side end plate 7, respectively.

The fixed electrode 3 is fixed in a condition that it passes through the fixed-side end plate 6. One end of the fixed-side electrode 3 is fixed to be opposed to one end of the movable electrode 4 in the vacuum container 2. An end portion of the fixed electrode 3, which is opposed to the movable electrode, is formed with an electrode contact material 8, which is the electrode material according to the embodiment of the present invention.

The movable electrode 4 is provided at the movable-side end plate 7. The movable electrode 4 is provided to be coaxial with the fixed electrode 3. The movable electrode 4 is moved in an axial direction by an opening/closing means not shown in the drawings, thereby conducting an opening or closing between the fixed electrode 3 and the movable electrode 4. An end portion of the movable electrode 4, which is opposed to the fixed electrode 3, is formed with an electrode contact material 8. Bellows 9 are provided between the movable electrode 4 and the movable-side end plate 7. Therefore, while vacuum of the inside of the vacuum container 2 is maintained, the movable electrode 4 is moved in a vertical direction to conduct an opening/closing between the fixed electrode 3 and the movable electrode 4.

Arc-resistant component particle size distribution was determined by a laser diffraction-type, particle size distribution measurement apparatus (a company CILAS; CILAS 1090L). Density of the sintered body was measured, and packing percentage was calculated from (measured density/theoretical density)·100(%). Evaluation of withstand voltage capability was conducted by measuring 50% flashover voltage while using each electrode material as an electrode (electrode contact material) of a vacuum interrupter. Withstand voltage capabilities of Examples (and Reference Example and other Comparative Examples) are shown by relative values based on the electrode material of Comparative Example 1 (reference value: 1.0). Arc-resistant component dispersion property was evaluated by observing an electron microscope image and by existence of aggregated particles therein.

TABLE 1

| | | MoCr particle size distribution | | | | | | | | | |
|---|---|---|---|---|---|---|---|---|---|---|---|
| Classification | Cu—Cr—Mo Mixing ratio | Particle size x1 (μm) | Particle size x2 (μm) | Frequency y1 (%) | Frequency y2 (%) | y1/y2 | Packing percentage (%) | Brinell hardness | Conductivity (% IACS) | Withstand voltage capability | MoCr dispersion property |
| Com. Ex. 1 | Cu80—Cr20 (conventional product) | — | 80 | — | 3.95 | — | 94.7% | 53.3 | 56.0 | 1.0 | ○ |
| Example 1 | Cu80—Cr16—Mo4 | 13 | 66 | 2.73 | 3.55 | 0.77 | 93.3% | 63.4 | 54.6 | 1.3 | ○ |
| Example 2 | Cu80—Cr12—Mo8 | 10 | 60 | 3.12 | 2.52 | 1.24 | 89.2% | 58.2 | 50.9 | undetermined | ○ |
| Ref. Ex. 1 | Cu80—Cr10—Mo10 | 9 | 56 | 3.59 | 2.21 | 1.58 | 85.5% | 53.4 | 48.1 | — | ○ |
| Com. Ex. 2 | Cu80—Cr8—Mo12 | 8 | 56 | 3.33 | 2.06 | 1.62 | 82.5% | 49.7 | 47.1 | — | X |
| Com. Ex. 3 | Cu80—Cr2—Mo18 | 8 | 36 | 4.52 | 0.90 | 5.02 | 84.3% | 51.3 | 51.1 | undetermined | X |
| Example 3 | Cu85—Cr12—Mo3 | 13 | 66 | 2.73 | 3.55 | 0.77 | 95.0% | 61.3 | 64.1 | — | ○ |
| Example 4 | Cu90—Cr8—Mo2 | 13 | 66 | 2.73 | 3.55 | 0.77 | 95.9% | 56.5 | 70.4 | — | ○ |

The main shield 10 is provided to cover a contact portion between the electrode contact material 8 of the fixed electrode 3 and the electrode contact material 8 of the movable electrode 4, thereby protecting the insulating sleeve 5 from an arc that occurs between the fixed electrode 3 and the movable electrode 4.

Comparative Example 1

Figure 3:
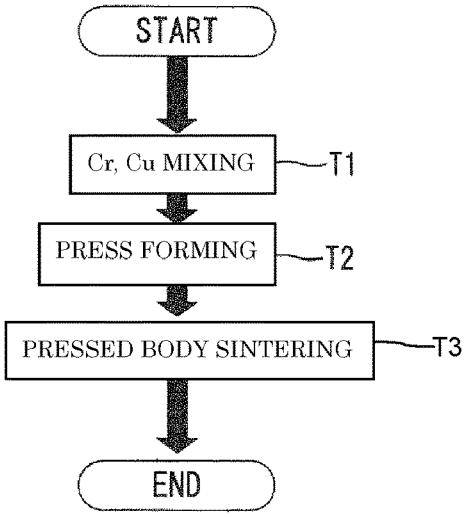
FIG. 3 is a flowchart of an electrode material production method according to Comparative Example 1.

There was produced a Cu—Cr electrode material as an electrode material according to Comparative Example 1. The Cu—Cr electrode material was produced in accordance with the flow shown in FIG. 3. In the electrode material according to Comparative Example 1, termite Cr powder having a median size of 80 μm or less and Cu powder having a median size of 100 μm or less were used.

Firstly, Cu powder and Cr powder were mixed together in a weight ratio of Cu:Cr=4:1, and it was sufficiently mixed until becoming homogeneous by using a V-type mixer (Step T1).

After mixing, a compact was produced by press molding (Step T2), followed by the primary sintering in a non-oxidizing atmosphere at 1070° C. for two hours to obtain an electrode material (Step T3).

Figure 4:
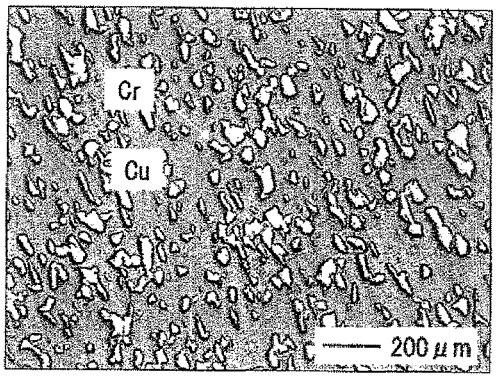
FIG. 4(*a*) is a sectional microphotograph of the electrode material according to Comparative Example 1, FIG. 4(*b*) is a sectional microphotograph of an electrode material according to Example 1, and FIG. 4(*c*) is a sectional microphotograph of an electrode material according to Comparative Example 3.
Figure 4:
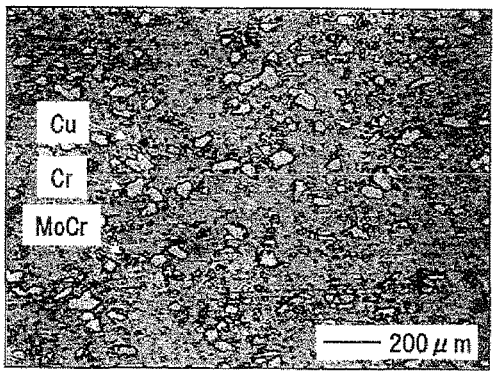
Figure 4:
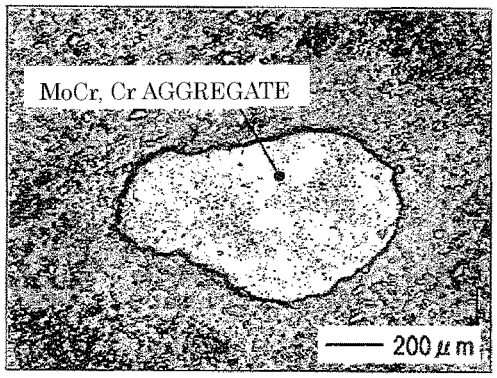

As shown in FIG. 4(*a*), the electrode material according to Comparative Example 1 was an electrode material having a texture in which Cr particles are uniformly dispersed in Cu phase. Characteristics (arc-resistant component particle size distribution, packing percentage, Brinell hardness, conductivity, withstand voltage capability, and arc-resistant component dispersion property) of the electrode material according to Comparative Example 1 are shown in Table 1.

Example 1

The electrode material according to Example 1 was produced in accordance with the flow shown in FIG. 1. In the electrode material according to Example 1, Mo powder having a median size of 10 μm or less, termite Cr powder having a median size of 80 μm or less and Cu powder having a median size of 100 μm or less were used. The electrode materials according to the other examples, reference example and comparative examples in the first embodiment were also produced by using the same raw materials.

Firstly Mo powder and Cr powder were mixed together in a weight ratio of Mo:Cr=1:4, and it was homogeneously mixed by using a V-type mixer (Step T1).

Figure 5:
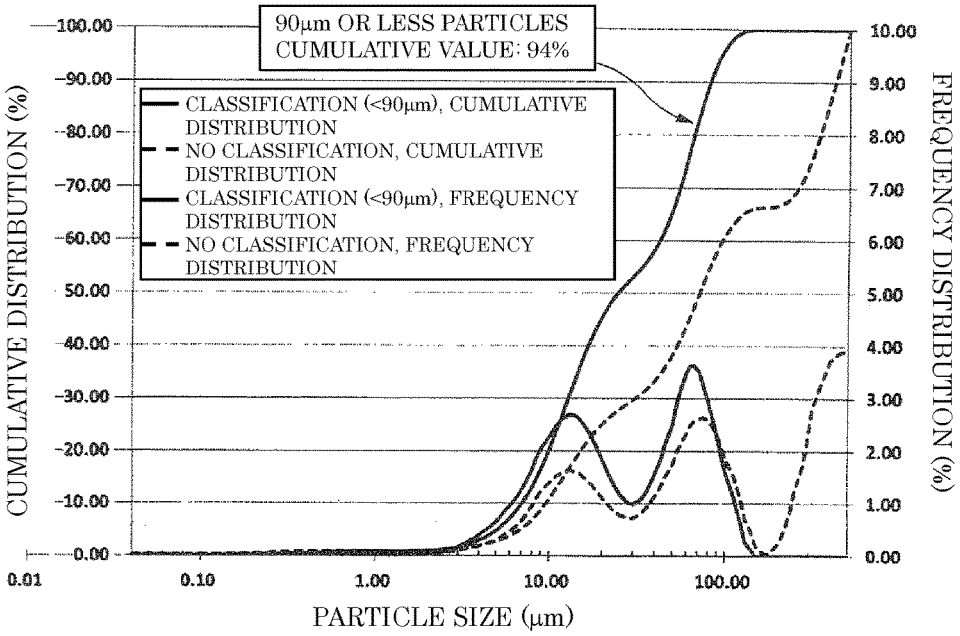
FIG. 5 is a graph showing the particle size distribution of MoCr powder before and after classification.

After mixing, this mixed powder of Mo powder and Cr powder was transferred into an alumina container and subjected to a heat treatment in a non-oxidizing atmosphere at 1150° C. for six hours. A porous body as the obtained reaction product was pulverized and then classified by a sieve having an opening of 90 μm, thereby obtaining MoCr powder. As shown in FIG. 5, as a result of classifying the pulverized MoCr powder, particles having a particle size of 90 μm or less of the MoCr powder were 94% in volume relative particle amount (cumulative amount).

Next, Cu powder and the classified MoCr powder were homogeneously mixed together in a weight ratio of Cu:MoCr=4:1, followed by making into a compact by press molding and then a primary sintering in a non-oxidizing atmosphere at 1070° C. for two hours to obtain an electrode material.

As shown in FIG. 4(*b*), in the electrode material according to Example 1, Cr that had remained in the sintering step of Mo—Cr mixed powder and fine MoCr particles as an alloy were uniformly dispersed in Cu phase without aggregation.

Furthermore, characteristics of the electrode material according to Example 1 are shown in Table 1. As shown in Table 1, as compared with the electrode material of Comparative Example 1, the electrode material of Example 1 was 19% higher in electrode hardness and 30% higher in withstand voltage capability when installed in a vacuum interrupter.

Example 2

The electrode material according to Example 2 was prepared by the same method as that for producing the electrode material of Example 1, except in that the mixing ratio of Mo powder and Cr powder in Mo—Cr mixing step S1 was different.

Mo powder and Cr powder were mixed together in a weight ratio of Mo Cr=2:3, and the electrode material was prepared in accordance with the flow shown in FIG. 1.

When the electrode material according to Example 2 was observed by an electron microscope, it was an electrode material having a texture in which MoCr particles and Cr particles were uniformly dispersed while aggregation of MoCr and Cr was not seen in the electrode texture.

Furthermore, characteristics of the electrode material according to Example 2 are shown in Table 1. As shown in Table 1, as compared with the electrode material of Comparative Example 1, the electrode material according to Example 2 is 9% higher in electrode hardness. Therefore, it is considered to have a withstand voltage capability that is equal or superior to that of the electrode material of Comparative Example 1.

Reference Example 1

The electrode material according to Reference Example 1 was prepared by the same method as that for producing the electrode material of Example 1, except in that the mixing ratio of Mo powder and Cr powder in Mo—Cr mixing step S1 was different.

Mo powder and Cr powder were mixed together in a weight ratio of Mo:Cr=1:1. and the electrode material was prepared in accordance with the flow shown in FIG. 1.

When the electrode material according to Reference Example 1 was observed by an electron microscope, it was an electrode material having a texture in which MoCr particles and Cr particles were uniformly dispersed while aggregation of MoCr and Cr was not seen in the electrode texture.

Furthermore, characteristics of the electrode material according to Reference Example 1 are shown in Table 1. As shown in Table 1, as compared with the electrode material of Comparative Example 1, the electrode material according to Reference Example 1 has an equivalent electrode hardness. Therefore, it is considered to have a withstand voltage capability that is equal to that of the electrode material of Comparative Example 1.

Comparative Example 2

The electrode material according to Comparative Example 2 was prepared by the same method as that for producing the electrode material of Example 1, except in that the mixing ratio of Mo powder and Cr powder in Mo—Cr mixing step S1 was different.

Mo powder and Cr powder were mixed together in a weight ratio of Mo:Cr=3:2, and the electrode material was prepared in accordance with the flow shown in FIG. 1.

When the electrode material according to Comparative Example 2 was observed by an electron microscope, MoCr aggregates of about 500 μm were confirmed in the electrode texture.

Furthermore, characteristics of the electrode material according to Comparative Example 2 are shown in Table 1. As shown in Table 1, as compared with the electrode material of Comparative Example 1, the electrode material according to Comparative Example 2 was 12% lower in packing percentage. As packing percentage of the electrode material lowers, brazing material would be absorbed by the electrode material in the case of using the electrode material as an electrode contact material. Therefore, it causes lowering of brazing property of the electrode material. Furthermore, as compared with the electrode material of Comparative Example 1, the electrode material of Comparative Example 2 is lower in electrode hardness. Therefore, it is considered to be lower in withstand voltage capability than the electrode material of Comparative Example 1.

Comparative Example 3

The electrode material according to Comparative Example 3 was prepared by the same method as that for producing the electrode material of Example 1, except in that the mixing ratio of Mo powder and Cr powder in Mo—Cr mixing step S1 was different.

Mo powder and Cr powder were mixed together in a weight ratio of Mo:Cr=9:1, and the electrode material was prepared in accordance with the flow shown in FIG. 1.

As shown in FIG. 4(*c*), when the electrode material according to Comparative Example 3 was observed by an electron microscope, MoCr aggregates of about 500 μm were confirmed in the electrode texture.

Furthermore, characteristics of the electrode material according to Comparative Example 3 are shown in Table 1. As shown in Table 1, as compared with the electrode material of Comparative Example 1, the electrode material according to Comparative Example 3 was 10% lower in packing percentage. Therefore, similar to the electrode material of Comparative Example 2, the electrode material according to Comparative Example 3 is also considered to be low in brazing property. Furthermore, as compared with the electrode material of Comparative Example 1, the electrode material of Comparative Example 3 is lower in electrode hardness. Therefore, it is considered to be lower in withstand voltage capability than the electrode material of Comparative Example 1.

Example 3

The electrode material according to Example 3 was prepared by the same method as that of Example 1, except in that the mixing ratio of Cu powder and MoCr powder in Cu mixing step S4 was different.

Regarding the electrode material according to Example 3, in Cu mixing step S4 of the flow shown in FIG. 1, the powder resulting from the pulverization (and classification) in the pulverization and classification step S3 was homogeneously mixed with Cu powder in a weight ratio of Cu:MoCr=17:3. Then, a compact was prepared by press molding, followed by a primary sintering in a non-oxidizing atmosphere at 1070° C. for two hours.

When the electrode material according to Example 3 was observed by an electron microscope, aggregates of MoCr particles and Cr particles were not confirmed, and it was an electrode material having a texture in which they were uniformly dispersed.

Characteristics of the electrode material according to Example 3 are shown in Table 1. As shown in Table 1, as compared with the electrode material of Comparative Example 1, the electrode material of Example 3 was improved by about 15% in electrode hardness and conductivity. Therefore, the electrode material according to Example 3 is considered to be an electrode material that is high in withstand voltage capability and is capable of lowering contact resistance of a vacuum interrupter.

Example 4

The electrode material according to Example 4 was prepared by the same method as that of Example 1, except in that the mixing ratio of Cu powder and MoCr powder in Cu mixing step S4 was different.

Regarding the electrode material according to Example 4, in Cu mixing step S4 of the flow shown in FIG. 1, the powder resulting from the pulverization (and classification) in the pulverization and classification step S3 was homogeneously mixed with Cu powder in a weight ratio of Cu:MoCr=9:1. Then, a compact was prepared by press molding, followed by a primary sintering in a non-oxidizing atmosphere at 1070° C. for two hours.

When the electrode material according to Example 4 was observed by an electron microscope, aggregates of MoCr particles and Cr particles were not confirmed, and it was an electrode material having a texture in which they were uniformly dispersed.

Characteristics of the electrode material according to Example 4 are shown in Table 1. As shown in Table 1, as compared with the electrode material of Comparative Example 1, the electrode material of Example 4 was improved by 26% in conductivity. Furthermore, the electrode material according to Example 4 is slightly improved in electrode hardness as compared with the electrode material of Comparative Example 1. Therefore, it is considered to have a withstand voltage capability that is equal or superior to the electrode material of Comparative Example 1.

As mentioned above, according to the electrode material production method of the first embodiment, it is possible to obtain an electrode material that is superior in conductivity and withstand voltage capability by mixing together Mo powder and Cr powder in a ratio such that Mo is less than Cr by weight.

That is, as shown in Patent Publication 3, even if electrode materials have the same composition, electrode material's characteristics become different by the difference in particle size distribution of arc-resistant metal (MoCr solid solution or Cr) to be dispersed in the electrode material. Thus, in the electrode material production method according to the embodiment of the present invention, a mixed powder of Mo powder and Cr powder obtained by a mixing in a ratio such that Mo is less than Cr by weight is sintered. Thereby, MoCr solid solution with the remaining Cr is prepared, and the obtained solid solution is pulverized. With this, it is possible to easily prepare arc-resistant metals having different particle sizes, that is, an arc-resistant metal (particles in the vicinity of particle size x1) containing MoCr as a main component and an arc-resistant metal (particles in the vicinity of particle size x2) containing the remaining Cr as a main component. As a result, it is possible to produce an electrode material that has a texture, in which arc-resistant metals are uniformly dispersed in the electrode texture without making aggregates, and that has a superior conductivity or withstand voltage capability as compared with conventional electrode materials.

For example, as shown in FIG. 5, in the electrode material of Example 1, MoCr powder obtained by the pulverization and classification step S3 has a particle size distribution having the maximum values (the most frequent values) at x1=13 μm and x2=66 μm. As this powder was analyzed by X-ray diffraction, the existence of Cr was confirmed. With this, it is understood that particles in the vicinity of particle size x1 are particles containing MoCr solid solution as a main component and that particles in the vicinity of particle size x2 are particles containing the remaining Cr as a main component.

Figure 6:
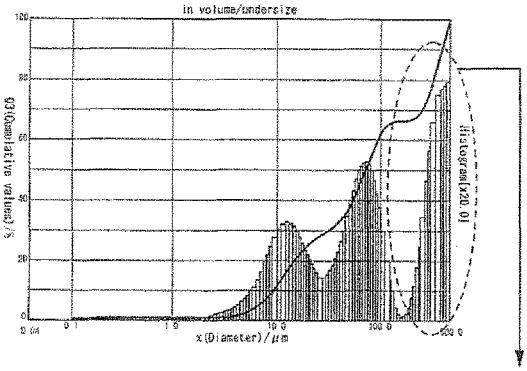
FIG. 6 is a microphotograph of MoCr powder having a particle size of around 500 μm.
Figure 6:
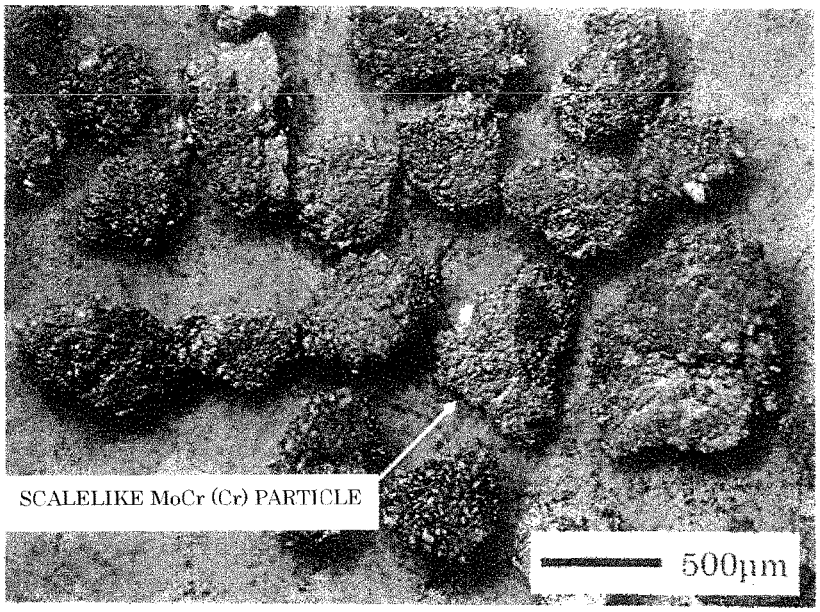

Furthermore, as shown in FIG. 6, the particle size distribution of MoCr powder before classification has the maximum value in the vicinity of a particle size of x3=500 μm. Particles in the vicinity of this particle size of x3 are considered to be particles containing scalelike MoCr (Cr) as a main component. They are considered to cause worsening in press formability, withstand voltage capability, breaking capacity and deposition resistance property.

Thus, in the electrode material production method according to the embodiment of the present invention, scalelike MoCr (Cr) particles are removed by the classification after the pulverization. In this manner, MoCr powder to be mixed with Cu powder is adjusted to 200 μm or less in particle size, and more preferably the particles having a particle size of 90 μm or less is adjusted to 90% or greater in volume relative particle amount, thereby improving characteristics of the electrode material, such as conductivity and withstand voltage capability.

Although particles previously classified into 90 μm or less are used as MoCr powder to be mixed with Cu powder in the electrode materials of Comparative Examples 2 and 3, aggregates of about 500 μm are confirmed in the electrode texture. Such high melting metals (Cr, Mo, and MoCr solid solution) existing in the electrode texture in an aggregated condition without dispersion cause lowering of withstand voltage property and lowering of deposition resistance property.

In contrast with this, in the electrode material production method according to the present invention, Mo powder and Cr powder to be mixed together in Mo—Cr mixing step S1 are in a ratio such that Mo is less than Cr by weight, thereby suppressing the occurrence of aggregates of MoCr solid solution and the remaining Cr in the primary sintering step S6 and improving conductivity and/or withstand voltage characteristic of the electrode material. It is known that, depending on the mixing ratio of Mo powder and Cr powder to be contained in the electrode material, withstand voltage property of the electrode material does not change so much, but deposition resistance property become different. Therefore, it is possible to produce an electrode material superior in deposition resistance property by adjusting the mixing ratio of Mo powder and Cr powder to a ratio such that Mo is less than Cr by weight, as compared with a case that Mo is greater than Cr.

It is possible to improve hardness and conductivity of the electrode material by optimizing the particle size distribution of MoCr powder and by adjusting the weight ratio of Cu powder to the electrode material to 80-90%, more preferably 85-90%. As a result, it becomes possible to produce a vacuum interrupter with a high pressure resistance and a large capacity.

For example, if median size of the heat-resistant element (e.g., Mo) is adjusted to 10 μm or less and if median size of Cr powder is adjusted to 80 or less, it is possible to obtain MoCr powder having at least two maximum values at a particle size x1 (x1=8-15 μm) and a particle size x2 (x2=56-70 μm) in the particle size distribution of the powder obtained by the baking step S2 and the pulverization and classification step S3. Furthermore, if Mo powder and Cr powder are mixed together in a ratio such that Mo is less than Cr by weight, frequency y1 of particle size x1 and frequency y2 of particle size x2 are such that at least $y1/y2<1.6$ is satisfied. If particle size distribution (and pulverization condition, pulverization method, etc.) of MoCr powder to be mixed with Cu powder is adjusted such that $y1/y2<1.6$ is satisfied, the generation of MoCr (Cr) aggregates is suppressed, when a mixed powder of Cu powder and MoCr powder is sintered to obtain an electrode material.

Second Embodiment

By forming an arc-resistant metal's fine dispersion texture as described in Patent Publication 2, withstand voltage capability and breaking capability are improved, but deposition resistance capability becomes worse to result in a deposition between the electrodes when applying a large current in a closed condition of the electrodes. This lowering of deposition resistance capability causes vacuum circuit breakers to have larger sizes, and this has been a task for mass-production.

Thus, the inventors tried to produce an electrode material having superior withstand voltage capability and deposition resistance capability by adding a low melting metal (e.g., Te, etc.) to an electrode material having a MoCr fine dispersion texture.

However, in the sintering step of a MoCr fine dispersion electrode material containing a low melting metal added thereto, there was a risk that empty holes were generated in the electrode interior to result in lowering of packing percentage of the electrode material. If packing percentage of the electrode material lowers by the generation of empty holes in the electrode material, there is a risk that brazing material (e.g., Ag) is absorbed into empty holes of the electrode's inside in the brazing step to result in difficulty in brazing of the electrode material.

As described in the first embodiment, the electrode material prepared by a sintering method using MoCr solid solution powder, which contains Mo and Cr in a ratio such that Cr is greater than Mo by weight, and Cu powder resulted in an electrode material having a texture, in which MoCr alloy is finely dispersed in Cu base material, and having superior withstand voltage capability and deposition resistance capability as compared with conventional CuCr electrode materials. Furthermore, when a MoCr solid solution powder containing Mo and Cr in a ratio such that Cr was greater than Mo by weight was used, it resulted in an electrode material with a higher deposition resistance capability, as compared with the case of using a MoCr solid solution powder containing Mo and Cr in a ratio such that Cr was less than Mo by weight.

In order to downsize an operation mechanism for conducting opening and closing movements of the electrodes in a vacuum circuit breaker, it is desirable to further improve deposition resistance capability to reduce the peeling force when the electrode material has deposited. In order to do that, it is considered to add a low melting metal to the mixed powder of Cu powder and MoCr solid solution powder (e.g., Patent Publication 4). In the case of adding a low melting metal, however, packing percentage of the electrode material lowers. Therefore, there is a risk that brazing property between the electrode contact and the electrode rod becomes inferior.

Based on the above-mentioned situation, the inventors conducted an eager study and reached completion of the invention according to the second embodiment. The invention according to the second embodiment is an invention relating to a Cu—Cr-heat resistant element (Mo, W, V, etc.)-low melting metal (Te, Bi, etc.) electrode material, composition control technique. As compared with conventional electrode materials containing low melting metals, it improves packing percentage of the electrode material and improves brazing property of the electrode material by limiting median size of the low melting metal powder. The electrode material according to the second embodiment is an electrode material that is superior in withstand voltage capability and deposition resistance capability and is superior in brazing property. Therefore, it becomes possible to downsize a vacuum interrupter and a vacuum circuit breaker by using an electrode material of the present invention as an electrode contact of the vacuum interrupter.

As the heat-resistant element, an element described in the first embodiment can be used singly or in combination. In the case of using the heat-resistant element as a powder, median size d50 of the heat-resistant element powder and its amount to be contained relative to the electrode material are similar to those described in the first embodiment. Since the amount of the low melting metal to be contained in the electrode material is a trace amount, the content of the heat-resistant element that is contained in a powder to be mixed with the low melting metal powder can be considered as the content of the heat-resistant element that is contained in the electrode material (Cr and Cu are also similar).

As the low melting metal, an element selected from elements such as tellurium (Te), bismuth (Bi), selenium (Se) and antimony (Sb) can be used singly or in combination. If the low melting metal is contained by 0.05-0.30 weight % relative to the electrode material (the total weight of the heat-resistant element, Cr and Cu), it is possible to improve the electrode material in deposition resistance capability. In the case of using the low melting metal as a powder, the electrode material is improved in packing percentage by adjusting median size d50 of the low melting metal powder to 5-40 μm, more preferably 5-11 μm.

Chromium (Cr) and copper (Cu) are similar to those in the first embodiment. That is, the contents of Cr and Cu to be contained in the electrode material and median sizes d50 of Cu powder and Cu powder are similar to those in the first embodiment. In the electrode material prepared by the sintering method, it is possible to freely set the Cu weight ratio by adjusting the amount of Cu powder to be mixed with the solid solution powder of the heat-resistant element and Cr. Therefore, the total of the heat-resistant element, the low melting metal, Cr and Cu, which are added to the electrode material, does not exceed 100 weight %.

The electrode material production method according to the second embodiment of the present invention is explained in detail with reference to the flow of FIG. 7. In the explanation of the embodiment, the heat-resistant element is exemplified by Mo, and the low-melting metal is exemplified by Te, but it is similar in the case of using other heat-resistant elements and low melting metal powders, too. Furthermore, the same (or similar) steps as those of the electrode material of the first embodiment have the same signs, and their detailed explanations are omitted in order to avoid repetition.

Firstly, Mo—Cr mixing step S1, baking step S2 and pulverization and classification S3 are conducted to obtain MoCr powder.

In pulverization and classification step S3, MoCr powder that is obtained by pulverizing MoCr sintered body is classified, for example, by a sieve of an opening of 200 μm, more preferably a sieve of an opening of 90 μm, to remove particles that are large in particle size. As shown in the first embodiment, MoCr powder to be mixed with Cu powder is adjusted to 200 μm or less, and more preferably is adjusted such that the volume relative particle amount of particles having a particle size of 90 μm or less becomes 90% or greater. This makes it possible to remove scalelike MoCr (Cr) particles and to produce an electrode material that is superior in withstand voltage capability and deposition resistance capability.

In Cu mixing step S7, MoCr powder obtained by the pulverization and classification step S3, the low melting metal powder (e.g., Te powder) and Cu powder are mixed together.

In press forming step S5, forming of the mixed powder obtained by Cu mixing step S7 is conducted. If a compact is produced by a press molding, it is not necessary to conduct machining on the compact after the sintering. Therefore, it can directly be used as an electrode (electrode contact).

In the primary sintering step S6, a compact. obtained by the press forming step S5 is sintered to produce an electrode material. In the primary sintering step S6, sintering of the compact is conducted, for example, in a non-oxidizing atmosphere (hydrogen atmosphere, vacuum atmosphere, etc.) at a temperature lower than Cu melting point (1083° C.). The sintering time of the primary sintering step S6 is suitably set in accordance with the sintering temperature. For example, the sintering time is set at two hours or longer.

Similar to the electrode material according to the first embodiment, it is possible to construct a vacuum interrupter 1 shown in FIG. 2 by using the electrode material according to the second embodiment of the present invention. Electrode contact 8 is joined to an end portion of the fixed electrode 3 or movable electrode 4 by a brazing material (e.g., Ag—Cu based brazing material).

prepared by using a Te powder having a median size of 9 μm, which has been derived from classification of a Te powder having a median size of 48 μm as a raw material powder. Upon preparation into the electrode material of Example 5, Mo powder having a median size of 10 μm or less, termite Cr powder having a median size of 80 μm or less and Cu powder having a median size of 100 μm or less were used (the same powders were used in other Examples, Comparative Examples and Reference Examples in the second embodiment).

Firstly, Mo powder and Cr powder were mixed together in a weight ratio of Mo:Cr=1:4. After mixing, the obtained mixed powder was transferred into an alumina container, followed by sintering in a vacuum furnace at 1150° C. for six hours. A porous body as the reaction product obtained by the sintering was pulverized and classified, thereby obtaining a powder of 90 μm or less.

This MoCr pulverized powder, Te powder and Cu powder were mixed together in a weight ratio of Cu:MoCr:Te=80:20:0.1, and it was sufficiently mixed until becoming homogeneous by using a V-type mixer. After mixing, a compact was produced by press forming of the mixed powder, and this compact was sintered at a temperature that is lower than melting point of Cu to produce an electrode material.

Figure 9:
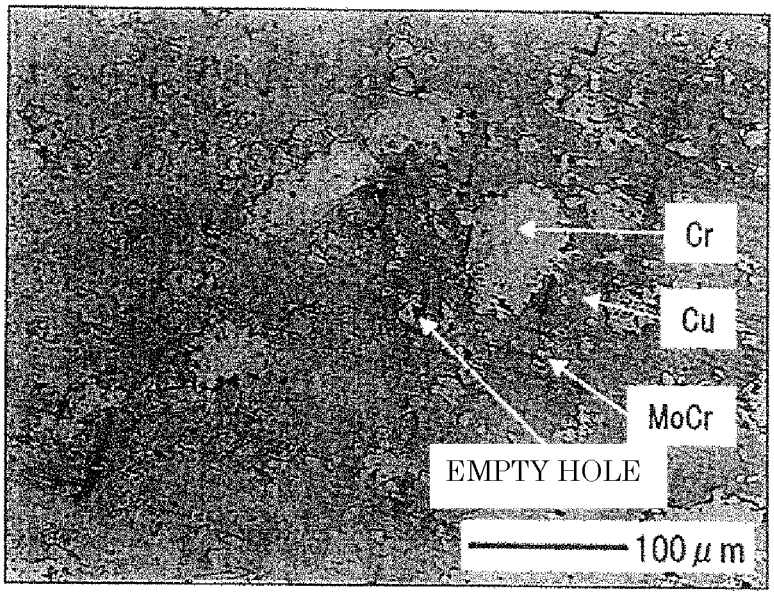
FIG. 9 is a sectional microphotograph of an electrode material according to Example 5.

FIG. 9 shows a sectional microscope photograph of the electrode material of Example 5. Furthermore, Table 2 shows characteristics of the electrode material of Example 5. After the measurement of density of the sintered body, packing percentage in Table 2 was calculated from (measured density/theoretical density)×100(%). Evaluation of withstand voltage capability was conducted by measuring 50% flashover voltage while using each electrode material as an electrode (electrode contact) of a vacuum interrupter. Withstand voltage capability of Reference Example 2 is shown by a relative value based on the electrode material of Comparative Example 4 (reference value: 1.0). Deposition resistance capability was evaluated by conducting a short-time withstand current (STC) test to see if deposition occurs between the electrodes (hereinafter referred to as deposition resistance test). Brazing property was evaluated in terms of two points by conducting a brazing with Ag—Cu based brazing material between the electrode material and a lead made of Cu to see if fillet was formed or not, and by hitting the brazed electrode material with a hammer to see if the electrode material comes off the lead or not.

TABLE 2

| Classification | Electrode material | Low melting metal median size μm | Packing percentage % | Brinell hardness | Withstand voltage capability | Deposition resistance capability | Brazing property | Evaluation |
|---|---|---|---|---|---|---|---|---|
| Com. Ex. 4 | Te0.05—CuCr remainder | 48 | 93.1% | 50 | 1.0 | Δ | ○ | Δ |
| Ref. Ex. 2 | Te0.1—CuCrMo remainder | 48 | 89.2% | 47 | 1.3 | ○ | X | X |
| Example 5 | Te0.1—CuCrMo remainder | 9 | 91.0% | 52 | — | — | ○ | ○ |
| Example 6 | Te0.1—CuCrMo remainder | 11 | 91.1% | 51 | — | — | ○ | ○ |
| Example 7 | Te0.1—CuCrMo remainder | 37 | 91.6% | 51 | — | — | Δ (No fillet formation | Δ |

Example 5

Figure 7:
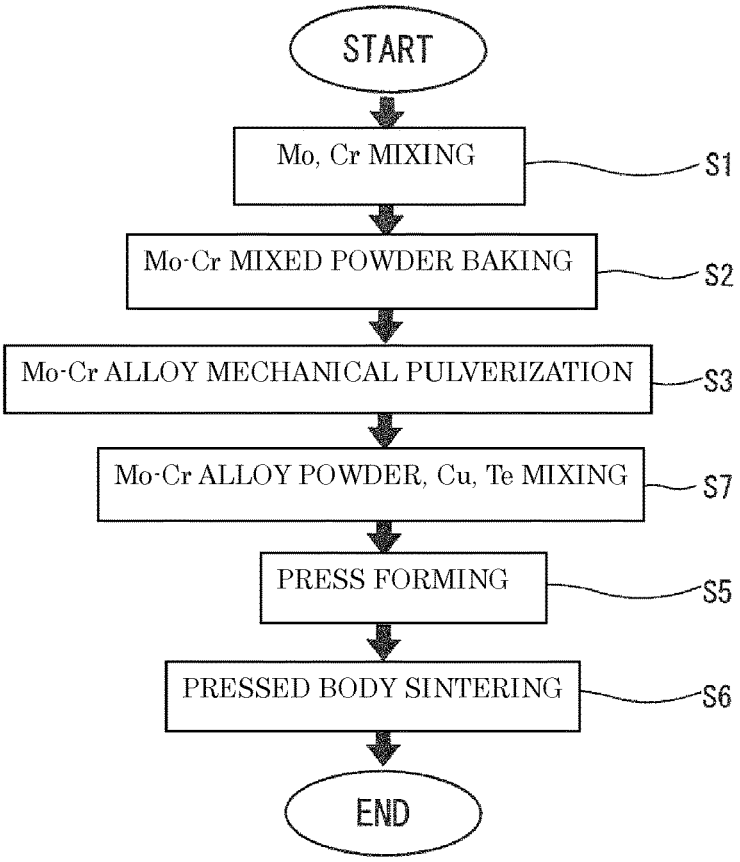
FIG. 7 is a flowchart of an electrode material production method according to the second embodiment of the present invention.
Figure 8:
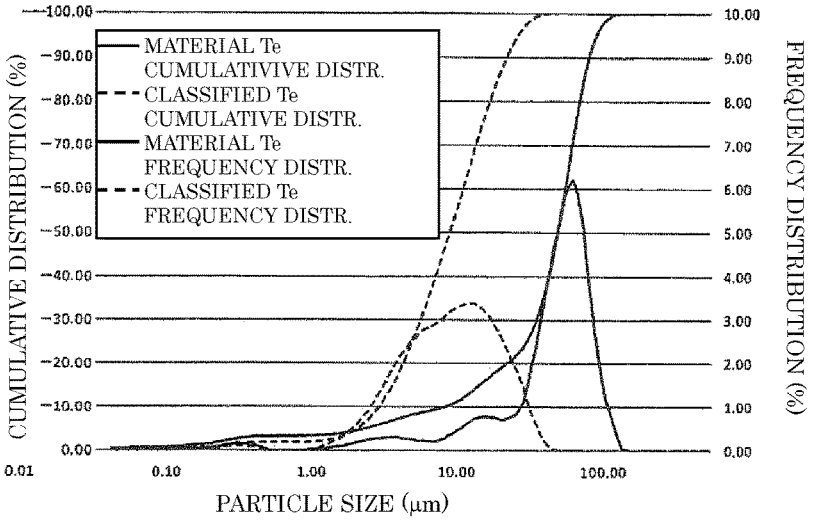
FIG. 8 is a graph showing the particle size distribution of the raw material Te powder and the particle size distribution of a Te powder used in the electrode material production of Example 5.

The electrode material of Example 5 was prepared in accordance with the flow of FIG. 7. As shown in FIG. 8, the electrode material of Example 5 is an electrode material As shown in Table 2, in the electrode material of Example 5, fillet of the brazing material was confirmed, and brazing property was good. The volume of the brazing material was 120 $cm^3$, and the area of the brazed part in the electrode material was 2.9 $cm^2$ (Examples 6 and 7, Reference Example 2, and Comparative Example 4 were also the same).

Example 6

The electrode material of Example 6 is an electrode material prepared by the same method for producing the electrode material of Example 5, except in that Te powder having a median size of 11 μm obtained by classifying the raw material Te powder was used. That is, the electrode material of Example 6 was prepared in accordance with the flow of FIG. 7. As shown in Table 2, as a result of examining brazing property of the electrode material of Example 6, fillet of the brazing material was confirmed, and therefore brazing property was good.

Example 7

The electrode material of Example 7 is an electrode material prepared by the same method for producing the electrode material of Example 5, except in that Te powder having a median size of 37 μm obtained by classifying the raw material Te powder was used. That is, the electrode material of Example 7 was prepared in accordance with the flow of FIG. 7. As shown in Table 2, as a result of examining brazing property of the electrode material of Example 7, although fillet of the brazing material was not confirmed, brazing was made with no separation of the electrode from the lead.

Comparative Example 4

The electrode material of Comparative Example 4 is an electrode material containing no heat-resistant element. For preparing the electrode of Comparative Example 4, Te powder having median size of 48 μm as shown in FIG. 8 was used.

Figure 10:
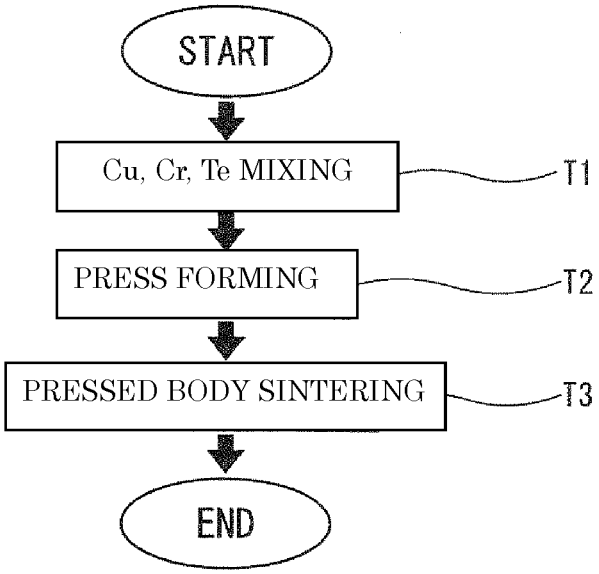
FIG. 10 is a flowchart of an electrode material production method according to Comparative Example 4.

The electrode material of Comparative Example 4 was prepared in accordance with the flow shown in FIG. 10.

Firstly, Cu powder, Cr powder and Te powder were sufficiently mixed together until becoming homogeneous in a weight ratio of Cu:Cr:Te=80:20:0.05 by using a V-type mixer. After mixing, the mixed powder was made into a compact by press molding. This compact was sintered at a temperature lower than melting point of Cu, thereby preparing an electrode material of Comparative Example 4. As shown in Table 2, fillet of the brazing material was confirmed, and therefore brazing property was good.

Reference Example 2

The electrode material of Reference Example 2 is an electrode material prepared by the same method as that of Example 5, except in that the median size of Te powder to be mixed in Cu mixing step S7 was different. That is, the electrode material of Reference Example 2 is an electrode material prepared in accordance with the flow shown in FIG. 7 by using Te powder having a median size of 48 μm.

Figure 11:
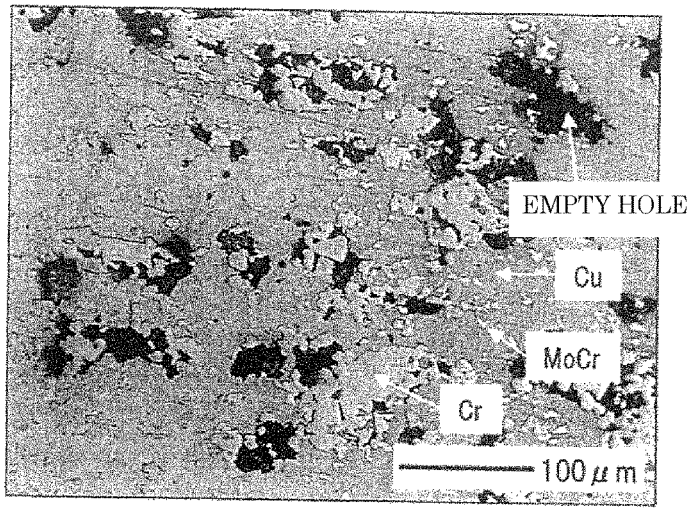
FIG. 11 is a sectional microphotograph of an electrode material according to Reference Example 2.

FIG. 11 shows a sectional photograph of the electrode material of Reference Example 2. As shown in Table 2, as a result of examining brazing property of the electrode material of Reference Example 2, fillet of the brazing material was not formed, and therefore brazing property was not good, resulting in separation of the electrode from the lead.

The electrode material of Reference Example 2 was superior to Comparative Example 4's electrode material (i.e., the current CuCrTe electrode material) in withstand voltage capability and deposition resistance capability, but lowered in packing percentage and Brinell hardness. This is considered to be caused by that the electrode material of Reference Example 2 has more inside empty holes by diffusion reactions of Mo and Cr and evaporation of Te during the sintering step than those of CuCrTe electrode. It is considered that, as the inside empty holes of the electrode material increase in this way, Ag as Ag—Cu based brazing material component is absorbed into the inside empty holes of the electrode, thereby making brazing impossible.

In contrast with this, as is clear from the microscope photograph of FIG. 9, in the electrode materials of Examples 5.7, empty holes occurring after evaporation of Te are small. Since the inside empty holes became small, packing percentage and Brinell hardness improved to the same level as that of the electrode material of Comparative Example 4. As a result, brazing by Ag—Cu based brazing material became possible. The electrode materials of Examples 5-7 were not subjected to the withstand voltage test and the deposition resistance test, but were higher than the electrode material of Reference Example 2 in packing percentage and Brinell hardness. Therefore, they are considered to have withstand voltage capability and deposition resistance capability, which are superior to those of the electrode material of Reference Example 2.

[Consideration of Amount of Low Melting Metal Added]

Next, electrode materials were prepared by changing the amount of the low melting metal added, and the evaluation of characteristics of the electrode materials were conducted. In the preparation of the electrodes of Reference Example 3 to Reference Example 17 and the electrodes of Comparative Example 5 to Comparative Example 8, Te powder having a median size of 48 μm was used. Therefore, brazing property of each electrode material is considered to be not good. Thus, when mounting each electrode material on a vacuum interrupter, the brazing was conducted by mixing Cu—Mn—Ni brazing material having a high brazing temperature and Cu—Ag brazing material. In this manner, even an electrode material having a low packing density can be brazed by elaborating the brazing material. However, if a plurality of brazing materials are used, there is a risk that the order of arranging the brazing materials falls into error, a wrong brazing material is used, etc. This may cause a difficulty for mass production.

Reference Example 3 to Reference Example 6

The electrode materials of Reference Example 3 to Reference Example 6 are electrode materials prepared by the same method for preparing the electrode material of Example 5, except in that Te powder having a median size of 48 μm was used and that the weight of Te to be contained in the electrode material was different. Therefore, the explanation of the same production steps as those of the method for producing the electrode material of Example 5 are omitted. The electrode materials of Reference Example 3 to Reference Example 6 have the same composition and are electrode materials prepared by the same method. They are samples with different pressure contact forces in the deposition resistance capability test. The pressure contact force is represented by a relative value provided that the smallest pressure contact force of the sample (i.e., the after-mentioned Reference Example 7) is a reference value of αN.

According to the flow of FIG. 7, the electrode materials of Reference Example 3 to Reference Example 6 were prepared. In Cu mixing step S7, Cu powder, MoCr pulverized powder and Te powder were mixed together in a ratio of Cu:MoCr:Te=80:20:0.05, and it was sufficiently mixed until becoming homogeneous by using a V-type mixer. After mixing, compacts were prepared, followed by sintering at a temperature lower than melting point of Cu, thereby obtaining electrode materials of Reference Example 3 to Reference Example 6.

A vacuum interrupter having the electrode materials of Reference Example 3 mounted as the fixed electrode and the movable electrode was attached to a vacuum circuit breaker. Then, deposition resistance capability test was conducted by adjusting the pressure contact force acting between the electrodes of the vacuum interrupter to α+20 N. Similarly, electrode materials of Reference Example 4 to Reference Example 6 were respectively mounted on the fixed electrodes and the movable electrodes. Then, deposition resistance capability tests were conducted on the vacuum circuit breakers by changing the pressure contact force acting between the electrodes of the vacuum interrupter to α+64 N (Reference Example 4), α+87 N (Reference Example 5) and α+131 N (Reference Example 6). Table 3 shows the test results of withstand voltage capability and deposition resistance capability of Reference Examples 3-6. Withstand voltage capabilities of Reference Examples 3-17, Comparative Examples 5-8 and Example 8 are shown by relative values based on the electrode material of Comparative Example 4 (reference value: 1.0).

TABLE 3

| Classification | Electrode material | Withstand voltage capability | STC test results: Pressure contact force | Deposition | Deposition force (N) | Evaluation |
|---|---|---|---|---|---|---|
| Com. Ex. 5 | Te0.05—CuCr remainder | 1.0 | α + 44 N | Yes | 2160 | Δ |
| Com. Ex. 6 | Te0.05—CuCr remainder | 1.0 | α + 64 N | Yes | 210 | |
| Com. Ex. 7 | Te0.05—CuCr remainder | 1.0 | α + 87 N | Yes | 1255 | |
| Com. Ex. 8 | Te0.05—CuCr remainder | 1.0 | α + 131 N | No | — | |
| Example 8 | CuCrMo | 1.3 | α + 194 N | Yes | 4080 | X |
| Ref. Ex. 3 | Te0.05—CuCrMo remainder | 1.3 | α + 20 N | No | — | ◎ |
| Ref. Ex. 4 | Te0.05—CuCrMo remainder | 1.3 | α + 64 N | No | — | |
| Ref. Ex. 5 | Te0.05—CuCrMo remainder | 1.3 | α + 87 N | No | — | |
| Ref. Ex. 6 | Te0.05—CuCrMo remainder | 1.3 | α + 131 N | No | — | |
| Ref. Ex. 7 | Te0.10—CuCrMo remainder | 1.3 | α | No | — | ◎ |
| Ref. Ex. 8 | Te0.10—CuCrMo remainder | 1.3 | α + 20 N | No | — | |
| Ref. Ex. 9 | Te0.10—CuCrMo remainder | 1.3 | α + 44 N | No | — | |
| Ref. Ex. 10 | Te0.10—CuCrMo remainder | 1.3 | α + 64 N | No | — | |
| Ref. Ex. 11 | Te0.10—CuCrMo remainder | 1.3 | α + 87 N | No | — | |
| Ref. Ex. 12 | Te0.10—CuCrMo remainder | 1.3 | α + 131 N | No | — | |
| Ref. Ex. 13 | Te0.30—CuCrMo remainder | 1.1 | α + 20 N | Yes | 2065 | Δ |
| Ref. Ex. 14 | Te0.30—CuCrMo remainder | 1.1 | α + 44 N | Yes | 2450 | |
| Ref. Ex. 15 | Te0.30—CuCrMo remainder | 1.1 | α + 64 N | No | — | |
| Ref. Ex. 16 | Te0.30—CuCrMo remainder | 1.1 | α + 87 N | Yes | 1180 | |
| Ref. Ex. 17 | Te0.30—CuCrMo remainder | 1.1 | α + 131 N | No | — | |

As shown in Table 3, deposition did not occur in any electrode material of Reference Example 3 to Reference Example 6. Therefore, it is understood that the electrode materials of Reference Example 3 to Reference Example 6 are superior in deposition resistance capability.

Reference Example 7 to Reference Example 12

The electrode materials of Reference Example 7 to Reference Example 12 are electrode materials prepared by the same method for preparing the electrode material of Reference Example 3, except in that the mixing ratio of Cu powder, MoCr pulverized powder and Te powder in Cu mixing step S7 was different. Therefore, different sections are explained in detail. The electrode materials of Reference Example 7 to Reference Example 12 are electrode materials having the same composition and prepared by the same method and are samples with different press contact forces in the deposition resistance capability test.

The electrode materials of Reference Example 7 to Reference Example 12 were prepared in accordance with the flow of FIG. 7. In Cu mixing step S7, Cu powder, MoCr pulverized powder and Te powder were mixed together in a weight ratio of Cu:MoCr:Te=80:20:0.1.

Similar to the electrode material of Reference Example 3, the electrode materials of Reference Example 7 to Reference Example 12 were respectively mounted on the fixed electrode and the movable electrode of the vacuum interrupters. Then, the vacuum interrupter was attached to a vacuum circuit breaker. The deposition resistance capability test was conducted by changing the pressure contact force acting between the electrodes of the vacuum interrupter to αN (Reference Example 7), α+20 N (Reference Example 8), α+44 N (Reference Example 9), α+64 N (Reference Example 10), α+87 N (Reference Example 11) and α+131 N (Reference Example 12). As shown in Table 3, deposition of the electrodes did not occur at any pressure contact force.

Reference Example 13 to Reference Example 17

The electrode materials of Reference Example 13 to Reference Example 17 are electrode materials prepared by the same method for preparing the electrode material of Reference Example 3, except in that the mixing ratio of Cu powder, MoCr pulverized powder and Te powder in Cu mixing step S7 was different. Therefore, different sections are explained in detail. The electrode materials of Reference Example 13 to Reference Example 17 are electrode materials having the same composition and prepared by the same method and are samples with different press contact forces in the deposition resistance capability test.

The electrode materials of Reference Example 13 to Reference Example 17 were prepared in accordance with the flow of FIG. 7. In Cu mixing step S7, Cu powder, MoCr pulverized powder and Te powder were mixed together in a weight ratio of Cu:MoCr:Te=80:20:0.3.

Similar to the electrode material of Reference Example 3, the electrode materials of Reference Example 13 to Reference Example 17 were respectively mounted on the fixed electrode and the movable electrode of the vacuum interrupters. Then, the vacuum interrupter was attached to a vacuum circuit breaker. The deposition resistance capability test was conducted by changing the pressure contact force acting between the electrodes of the vacuum interrupter to α+20 N (Reference Example 13), α+44 N (Reference Example 14), α+64 N (Reference Example 15), α+87 N (Reference Example 16) and α+131 N (Reference Example 17).

As shown in Table 3, deposition occurred between the electrodes when the pressure contact force was α+20 N, α+44 N and α+87 N. In contrast, when the pressure contact force was α+64 N and α+131 N, deposition did not occur between the electrodes. When the pressure contact force was α+44 N, a force of 2450 N was necessary to separate the deposited electrodes.

Comparative Example 5 to Comparative Example 8

The electrode materials according to Comparative Example 5 to Comparative Example 8 are electrode materials not containing the heat-resistant element (Mo). The electrode materials of Comparative Example 5 to Comparative Example 8 are electrode materials having the same composition and prepared by the same method as those of the electrode material of Comparative Example 4, and are samples with different press contact forces in the deposition resistance capability test.

The electrode materials of Comparative Example 5 to Comparative Example 8 were prepared in accordance with the flow of FIG. 10.

Cr powder, Te powder and Cu powder were mixed together in a weight ratio of Cu:Cr:Te=80:20:0.05, and it was sufficiently mixed until becoming homogeneous by using a V-type mixer. After mixing, a compact was prepared, followed by sintering at a temperature lower than melting point of Cu, thereby obtaining electrode materials of Comparative Example 5 to Comparative Example 8.

Similar to the electrode material of Reference Example 3, the electrode materials of Comparative Example 5 to Comparative Example 8 were respectively mounted on the fixed electrode and the movable electrode of the vacuum interrupters. Then, the vacuum interrupter was attached to a vacuum circuit breaker. The deposition resistance capability test was conducted by changing the pressure contact force acting between the electrodes of the vacuum interrupter to α+44 N (Comparative Example 5), α+64 N (Comparative Example 6), α+87 N (Comparative Example 7) and α+131 N (Comparative Example 8).

As shown in Table 3, deposition occurred between the electrodes in the electrode materials of Comparative Example 5 to Comparative Example 7, but deposition did not occur between the electrodes in the electrode material of Comparative Example 8. When the press contact force was at α+44 N as the minimum, a force of 2016 N was necessary to separate the deposited electrodes.

Example 8

The electrode material according to Example 8 is an electrode material prepared by the same method as that of Reference Example 3, except not containing the low melting metal (e.g., Te). The electrode material of Example 8 corresponds to an electrode material according to the first embodiment. Therefore, the electrode material of Example 8 was prepared in accordance with the flow of FIG. 1.

In Cu mixing step S4, the MoCr solid solution powder obtained by the pulverization and classification step S3 was mixed with Cu powder in a weight ratio of Cu:MoCr=4:1, and it was sufficiently mixed until becoming homogeneous by using a V-type mixer. After mixing, a compact was prepared, followed by sintering at a temperature lower than melting point of Cu, thereby obtaining an electrode material of Example 8.

Similar to the electrode material of Reference Example 3, the electrode materials of Example 8 were respectively mounted on the fixed electrode and the movable electrode of a vacuum interrupter. Then, the vacuum interrupter was attached to a vacuum circuit breaker. The pressure contact force to act between the electrodes of the vacuum interrupter was set at α+194 N to conduct the deposition resistance capability test. As shown in Table 3, the deposition between the electrodes occurred, and the force to separate the deposited electrodes was 4080 N.

As is clear from Table 3, the electrode materials of Reference Example 3 to Reference Example 17 and Example 8 were improved in withstand voltage capability by forming a fine dispersed texture of MoCr alloy in the Cu phase, as compared with the electrode materials of Comparative Example 5 to Comparative Example 8 as current electrode materials.

Although the electrode material of Example 8 was superior in withstand voltage capability, it was low in deposition resistance capability and deposition between the electrodes occurred in spite of high pressure contact force. That is, in the electrode material of Example 8, the force to separate the deposited electrodes is strong. Therefore, there is a risk that it is necessary to increase the size of the vacuum circuit breaker incorporating the vacuum interrupter, thereby increasing the production cost.

Thus, like the electrode materials of Reference Example 3 to Reference Example 12, if Te as a low melting metal is added to the electrode material, it is possible to improve deposition resistance capability without lowering withstand voltage capability as compared with the electrode material of Example 8. Regarding this, it is considered that, if a low melting metal is added to the electrode material, empty holes are generated at the Cu—Cr grain boundary and the Cu—MoCr grain boundary to lower binding strength of the grain boundary, thereby improving deposition resistance capability of the electrode material. However, like the electrode materials of Reference Example 13 to Reference Example 17, if increasing the amount of Te added in the electrode material, there is a risk of lowering withstand voltage capability of the electrode material. This is considered to be result from that, as the amount of the low melting metal added is increased, the generation of empty holes in the electrode material increases, thereby causing a considerable lowering of the electrode material in density. By lowering of the electrode material in density withstand voltage capability of the electrode material is lowered, thereby increasing the contact resistance. Therefore, it is considered that an electrode material superior in deposition resistance can be obtained without lowering of withstand voltage capability and/or current breaking capability by adjusting the low melting metal added to the electrode material to 0.3 weight % or lower relative to the electrode material.

Thus, it is possible to improve deposition resistance capability of the electrode material by adding a small amount of the low melting metal (e.g., 0.05-0.3 weight % Te relative to the total weight of Cu, Cr and Mo) to the CuCrMo electrode material.

Although the binding strength at the grain boundary is lowered by the generation of empty holes at the grain boundary, there is a risk to cause lowering of the electrode material in packing percentage. For example, in the electrode material of Reference Example 2 in Table 2, packing percentage is 89.2%. Thus, as packing percentage of the electrode material is lowered, there is a risk of lowering of the electrode material in brazing property.

In contrast with this, like the electrode materials of Example 5 to Example 7, if using a Te powder having a median size adjusted to from 5 μm to 40 μm, it is possible to make small pores, which are generated in the sintering step of the CuCrMoTe electrode having a finely dispersed texture of CrMo alloy formed therein, thereby improving the electrode material in hardness and packing percentage.

That is, according to the electrode material and the electrode material production method related to the second embodiment of the present invention, it is possible to obtain an electrode material superior in deposition resistance capability and brazing property without lowering of the electrode material in withstand voltage capability and current breaking capability by using a low melting metal powder having a median size adjusted to from 5 μm to 40 μm. As a result, it has become possible to conduct brazing with Ag—Cu based brazing material, which was not achieved by an electrode material using a conventional low melting metal powder. Due to being superior in brazing property, in mass production, the production cost is reduced, and yield is improved.

Furthermore, according to the electrode material production method related to the second embodiment of the present invention, it is possible to obtain an electrode material having a packing percentage of 90% or greater and a Brinell hardness of 50 or greater. Such electrode material high in density and hardness becomes an electrode material that is superior in withstand voltage capability and is small in electrode wear.

Furthermore, according to the electrode material production method related to the second embodiment of the present invention, it is possible to produce an electrode material that is high in packing percentage. Since this electrode material has a superior withstand voltage capability by having a MoCr fine dispersion texture and a deposition resistance capability higher than that of the current Cu—Cr electrodes, it becomes possible to produce a small-sized vacuum interrupter. That is, withstand voltage capability of the electrode contact of a vacuum interrupter is improved by mounting the electrode material according to the second embodiment of the present invention on at least one of the fixed electrode and the movable electrode, for example, of a vacuum interrupter (VI). As withstand voltage capability of the electrode contact is improved, it is possible to shorten the gap between the movable side electrode and the fixed side electrode at the opening/closing time as compared with conventional vacuum interrupters and to shorten the gap between the electrode and the insulating sleeve, too. Therefore, it becomes possible to make structure of the vacuum interrupter small. Furthermore, as deposition resistance capability of the electrode material is improved, it is possible to make small an operation mechanism for conducting an opening/closing movement of the vacuum interrupter, thereby contributing to making the vacuum circuit breaker have a small size.

As above, the explanation of the embodiments was conducted by showing preferable modes of the present invention, but the electrode material production method and the electrode material of the present invention are not limited to the embodiments. It is possible to suitably change the design in a range of not impairing characteristics of the invention, and the embodiment with the changed design also belongs to the technical scope of the present invention.

For example, the MoCr solid solution powder is not limited to one produced by a preliminary sintering of Mo powder and Cr powder and then pulverization and classification, but it is possible to use a MoCr solid solution powder containing Mo and Cr in a ratio such that Cr is greater than Mo by weight. Furthermore, it is possible to produce an electrode material superior in withstand voltage capability by using, for example, a powder of 80 μm or less at 50% by cumulation for the MoCr solid solution powder.

Furthermore, withstand voltage capability of the electrode contact of a vacuum interrupter is improved by mounting the electrode material of the present invention on at least one of the fixed electrode and the movable electrode, for example, of a vacuum interrupter (VI). As withstand voltage capability of the electrode contact is improved, it is possible to shorten the gap between the movable side electrode and the fixed side electrode at the opening/closing time as compared with conventional vacuum interrupters and to shorten the gap between the electrode and the insulating sleeve, too. Therefore, it becomes possible to make structure of the vacuum interrupter small.

The invention claimed is:

1. A method for producing an electrode material by sintering a mixed powder containing 40-90% Cu, 5-48% Cr and 2-30% heat-resistant element by weight, comprising:

mixing a heat-resistant element powder and a Cr powder in a ratio such that the heat-resistant element is less than the Cr by weight;

baking a mixed powder of the heat-resistant element powder and the Cr powder;

pulverizing a sintered body that has been obtained by the baking and contains a solid solution of the heat-resistant element and the Cr;

classifying a solid solution powder that has been obtained by the pulverizing, to have a particle size of 200 μm or less; and mixing a solid solution powder that has been obtained by the classifying and a Cu powder, followed by the sintering.

2. The method for producing an electrode material as claimed in claim 1, wherein the solid solution powder that has been obtained by the classifying is such that a volume relative particle amount of a particle having a particle size of 90 or less is 90% or greater.

3. The method for producing an electrode material as claimed in claim 1, wherein a low melting metal powder that is 0.05-0.3% by weight and has a median size of 5-40 μm is mixed with a mixed powder of the solid solution powder obtained by the classifying and the Cu powder; and then a mixed powder obtained by mixing the low melting metal powder is sintered.

4. The method for producing an electrode material as claimed in claim 1, wherein the heat-resistant element powder has a median size of 10 μm or less.

5. The method for producing an electrode material as claimed in claim 1, wherein the Cr powder has a median size that is greater than that of the heat-resistant element powder and is 80 μm or less.

6. The method for producing an electrode material as claimed in claim 1, wherein the Cu powder has a median size of 100 μm or less.

7. The method for producing an electrode material as claimed in claim 1, wherein the heat-resistant element is Mo.

8. An electrode material containing 40-90% Cu, 5-48% Cr and 2-30% heat-resistant element by weight, the electrode material being obtained by:

mixing a heat-resistant element powder and a Cr powder in a ratio such that the heat-resistant element is less than the Cr by weight;

baking a mixed powder of the heat-resistant element powder and the Cr powder;

pulverizing a sintered body that has been obtained by the baking and contains a solid solution of the heat-resistant element and the Cr;

classifying a solid solution powder that has been obtained by the pulverizing, to have a particle size of 200 μm or less; and mixing a solid solution powder that has been obtained by the classifying and a Cu powder, followed by sintering.

9. The electrode material as claimed in claim 8, which is obtained by mixing a low melting metal powder that is 0.05-0.3% by weight and has a median size of 5-40 μm with a mixed powder of the solid solution powder obtained by the classifying and the Cu powder, and then sintering a mixed powder obtained by mixing the low melting metal powder.

10. The electrode material as claimed in claim 9, which has a packing percentage of 90% or greater and a Brinell hardness of 50 or greater.

11. A vacuum interrupter in which a movable electrode or a fixed electrode is equipped with an electrode contact comprising the electrode material as claimed in claim 8.

* * * * *